US008014687B2

(12) United States Patent
Sasaki

(10) Patent No.: US 8,014,687 B2
(45) Date of Patent: Sep. 6, 2011

(54) IMAGE FORMING APPARATUS THAT DETERMINES WHEN A LIFE OF A REPLACEMENT UNIT HAS EXPIRED

(75) Inventor: Miho Sasaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 808 days.

(21) Appl. No.: 12/068,563

(22) Filed: Feb. 7, 2008

(65) Prior Publication Data

US 2008/0212984 A1 Sep. 4, 2008

(30) Foreign Application Priority Data

Mar. 1, 2007 (JP) ..... 2007-051135

(51) Int. Cl.
*G03G 15/00* (2006.01)
*G03G 15/08* (2006.01)
*G03G 21/00* (2006.01)

(52) U.S. Cl. ..... 399/12; 399/24; 399/27; 399/31; 399/35

(58) Field of Classification Search ..... 399/12, 399/13, 24–27, 31, 35
See application file for complete search history.

(56) References Cited

U.S. PATENT DOCUMENTS 7,787,782 B2 * 8/2010 Takada ..... 399/12

FOREIGN PATENT DOCUMENTS

| | | |
|---|---|---|
| JP | A 2001-296775 | 10/2001 |
| JP | A 2003-149929 | 5/2003 |
| JP | A 2005-324487 | 11/2005 |
| JP | A 2005-326729 | 11/2005 |

* cited by examiner

*Primary Examiner* — William J Royer
(74) *Attorney, Agent, or Firm* — Oliff & Berridge, PLC

(57) ABSTRACT

An image forming apparatus includes: a replaceable constituent element; an information storage unit that holds information indicating a type of the constituent element received by a user interface; and a life calculation controller that, when at least one piece of the information stored in the information storage unit indicates a particular type, performs control to suppress calculation of a life of the constituent element.

16 Claims, 11 Drawing Sheets

OPERATING ENVIRONMENT CONTROL PROCESSING (S60)

LIFE DETECTION PROGRAM 200

FIRST LIFE DETECTION PROCESSING (S10)

SECOND LIFE DETECTION PROCESSING (S20)

THIRD LIFE DETECTION PROCESSING (S30)

TYPE INITIALIZATION PROCESSING (S40)

OPERATING ENVIRONMENT CONTROL PROCESSING (S50)

OPERATING ENVIRONMENT CONTROL PROCESSING (S60)

IMAGE FORMING APPARATUS THAT DETERMINES WHEN A LIFE OF A REPLACEMENT UNIT HAS EXPIRED

CROSS-REFERENCE TO RELATED APPLICATIONS

This application is based on and claims priority under 35 USC 119 from Japanese Patent Application No. 2007-051135 filed Mar. 1, 2007.

BACKGROUND

1. Technical Field

The present invention relates to an image forming apparatus.

2. Related Art

Generally, an image forming apparatus is often provided with a replaceable constituent element (hereinafter, also referred to as a "replacement unit") such as a toner cartridge. As this type of image forming apparatus, an apparatus in which the life of such replacement unit is detected is well known.

SUMMARY

According to an aspect of the invention, there is provided an image forming apparatus including: a replaceable constituent element; an information storage unit that holds information indicating a type of the constituent element received by a user interface; and a life calculation controller that, when at least one piece of the information stored in the information storage unit indicates a particular type, performs control to suppress calculation of a life of the constituent element.

BRIEF DESCRIPTION OF THE DRAWINGS

Exemplary embodiments of the present invention will be described in detail based on the following figures, wherein.

DETAILED DESCRIPTION

First, an image forming apparatus 10 according to a first exemplary embodiment of the present invention will be described.

Figure 1:
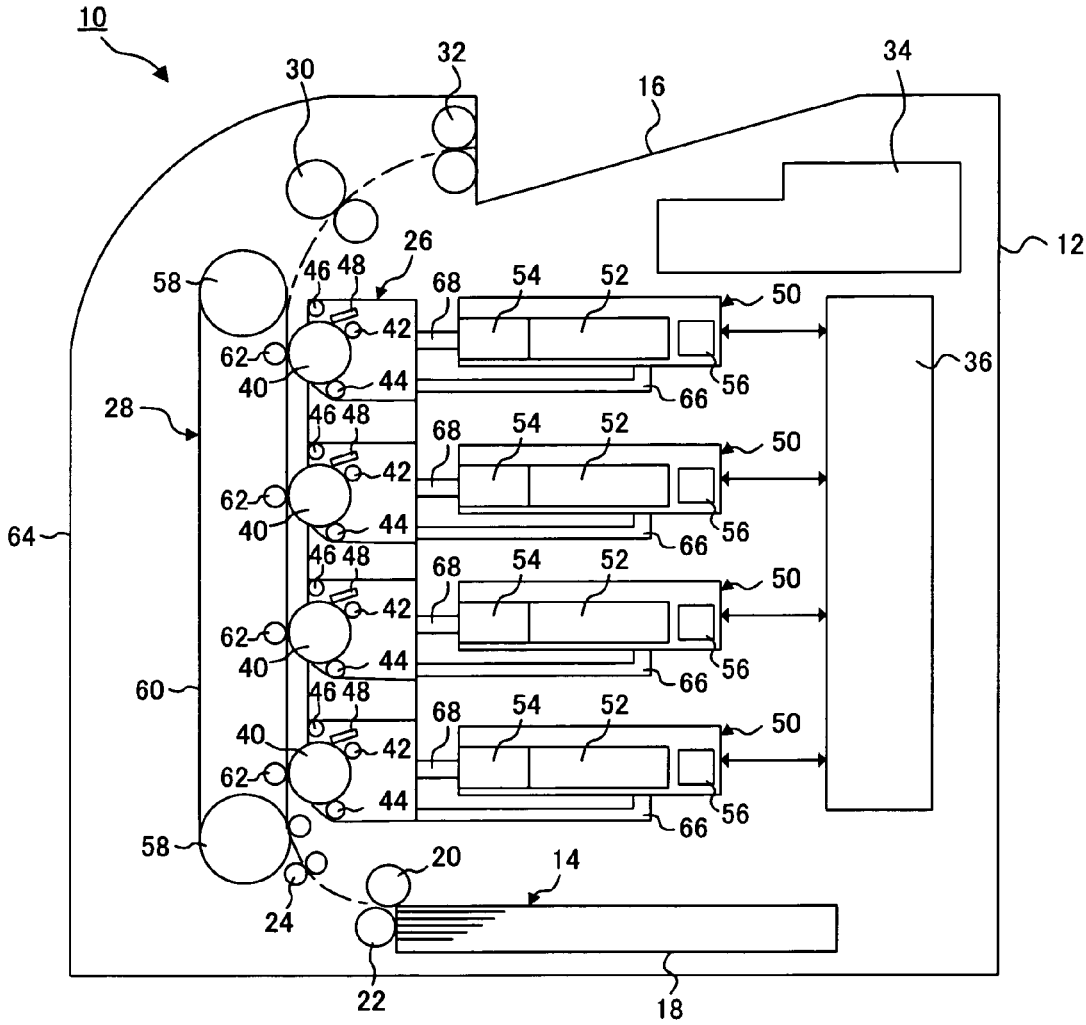
FIG. 1 is a cross-sectional view showing an image forming apparatus 10 according to exemplary embodiments of the present invention.

FIG. 1 is a cross-sectional view showing the image forming apparatus 10 according to exemplary embodiments of the present invention.

As shown in FIG. 1, the image forming apparatus 10 has an image forming apparatus main body 12. A paper feeder 14 is provided in a lower part of the image forming apparatus main body 12, and a paper discharge unit 16 is formed in an upper part of the image forming apparatus main body 12. Further, a rotatable open-close cover 64 is provided on the surface side of a side surface of the image forming apparatus main body 12.

The paper feeder 14 has a paper tray 18 on which a large number of paper sheets are stacked. A feed roller 20 is provided in an upper end position of the paper tray 18, and a retard roller 22 is provided in a position opposite to the feed roller 20. A top sheet on the paper tray 18 is picked up with the feed roller 20, retarded by cooperation between the feed roller 20 and the retard roller 22, and conveyed.

The sheet conveyed from the paper tray 18 is temporarily stopped with a registration roller 24, and passed between an image holder unit 26 to be described later and a transfer unit 28 and through a fixing device 30 and discharged with a paper discharge roller 32 to the paper discharge unit 16 at predetermined timing. Note that the sheet is not limited to a paper medium but may be an OHP sheet or the like.

The image holder unit 26, the transfer unit 28, a power source unit 34 and a controller 36 are provided in the image forming apparatus main body 12. The image holder unit 26 is attachable/removable to/from the image forming apparatus main body 12. The image holder unit 26 is attached/removed via an opening opened/closed by opening/closing the open-close cover 64.

The image holder unit 26 rotatably supports e.g. four image holders 40. The image holder 40 holds an image transferred onto a conveyance belt 60 to be described later or a sheet conveyed with the conveyance belt 60. A charging device 42 as a charger having a charging roller to uniformly charge the image holder 40, a developing device 44 to develop a latent image written on the image holder 40, a diselectrifying device 46 to diselectrify the image holder 40 after transfer, and a cleaning device 48 as a developing material removal unit to remove developing material remaining on the image holder 40 after the transfer, are provided around each image holder 40.

A developing material container 50 has a supplied developing material container 52 and a recovered developing material container 54 integrated with each other. The developing material container 50 is provided with a memory chip 56. The developing material container 50 is removably attached to the image forming apparatus main body 12, and is connected to the side of the rear surface side of the image holder unit 26. For example, four developing material containers 50 for magenta, yellow, cyan and black toner are projected. Note that the developing material container 50 is also referred to as a "toner box", and the supplied developing material contained in the supplied developing material container 52 and the recovered developing material contained in recovered developing material container 54 are also referred to as "toner" and "waste toner".

A first coupling member 66 couples the supplied developing material container 52 to the developing device 44. Accordingly, the supplied developing material container 52 is connected via the first coupling member 66 to the developing device 44. The first coupling member 66 is provided with, e.g., a screw conveyance member. A second coupling member 68 couples the cleaning device 48 to the recovered developing material container 54. Accordingly, the recovered developing material container 54 is connected via the second coupling member 68 to the cleaning device 48.

The memory chip 56 has a rewritable storage device such as a NVM (Non Volatile Memory) (not shown), a transmission unit, a reception unit, a power source unit, an antenna and the like. The memory chip 56 having the above configuration transmits/receives an electric wave signal to/from a radio communication controller 108 to be described later provided in the image forming apparatus main body 12, stores data included in the electric wave signal into the storage device, and transmits data stored in the storage device to the radio communication controller 108.

The memory chip 56 holds a serial number to uniquely identify the developing material container 50, date of manufacture, a life threshold value indicating the life of the developing material container 50 (e.g., toner life threshold value and waste toner life threshold value) and the like. Note that it may be arranged such that related information available to grasp the status of the developing material container 50 and its record such as a life count value indicating the amount of use from the start of use to the current time (e.g., a toner life count value and a waste toner life count value), the number of revolutions of the image holder 40 and the like, are stored in the memory chip 56.

Optical writing devices (not shown), respectively having a laser exposure device, are provided in positions corresponding to the respective image holders 40 on the rear surface side of the image holder unit 26. The optical writing devices emit laser light to the uniformly charged image holders 40 thereby forming latent images.

The transfer unit 28 is provided in a vertical direction in a position opposite to the image holder unit 26 on the front side of the image holder unit 26. In the transfer unit 28, the conveyance belt 60 is put on two support rollers 58 provided in the vertical direction. The conveyance belt 60 conveys an image or a sheet. Further, a transfer roller 62 is provided on the respective image holders 40 with the conveyance belt 60 between the transfer roller 62 and the respective image holders 40.

Accordingly, as the conveyance member provided in the first coupling member 66 is driven and rotated, toner of the respective colors is supplied from the supplied developing material container 52 of the developing material container 50 to the developing device 44 in the image holder unit 26. On the respective image holders 40 uniformly charged by the charging device 42, latent images are formed by the optical writing devices, and the latent images are visualized with toner by the developing devices 44. The toner images formed on the image holders 40 are transferred onto a sheet conveyed with the conveyance belt 60 in the transfer unit 28, and fixed to the sheet by the fixing device 30. Further, waste toner of respective colors is removed by the cleaning devices 48, and recovered in the recovered developing material container 54 of the developing material container 50.

In this manner, the image holder unit 26, the transfer unit 28 and the optical writing devices construct an image forming unit to form an image on a recording medium such as a paper sheet within a range of the life of the developing material container 50 calculated as described later. Note that the recovered developing material container 54 may be further provided in the image forming apparatus main body 12. In this case, waste toner is removed from, e.g., the image holder unit 26 and the transfer unit 28, and recovered into the recovered developing material container 54 provided in the image forming apparatus main body 12.

Figure 2:
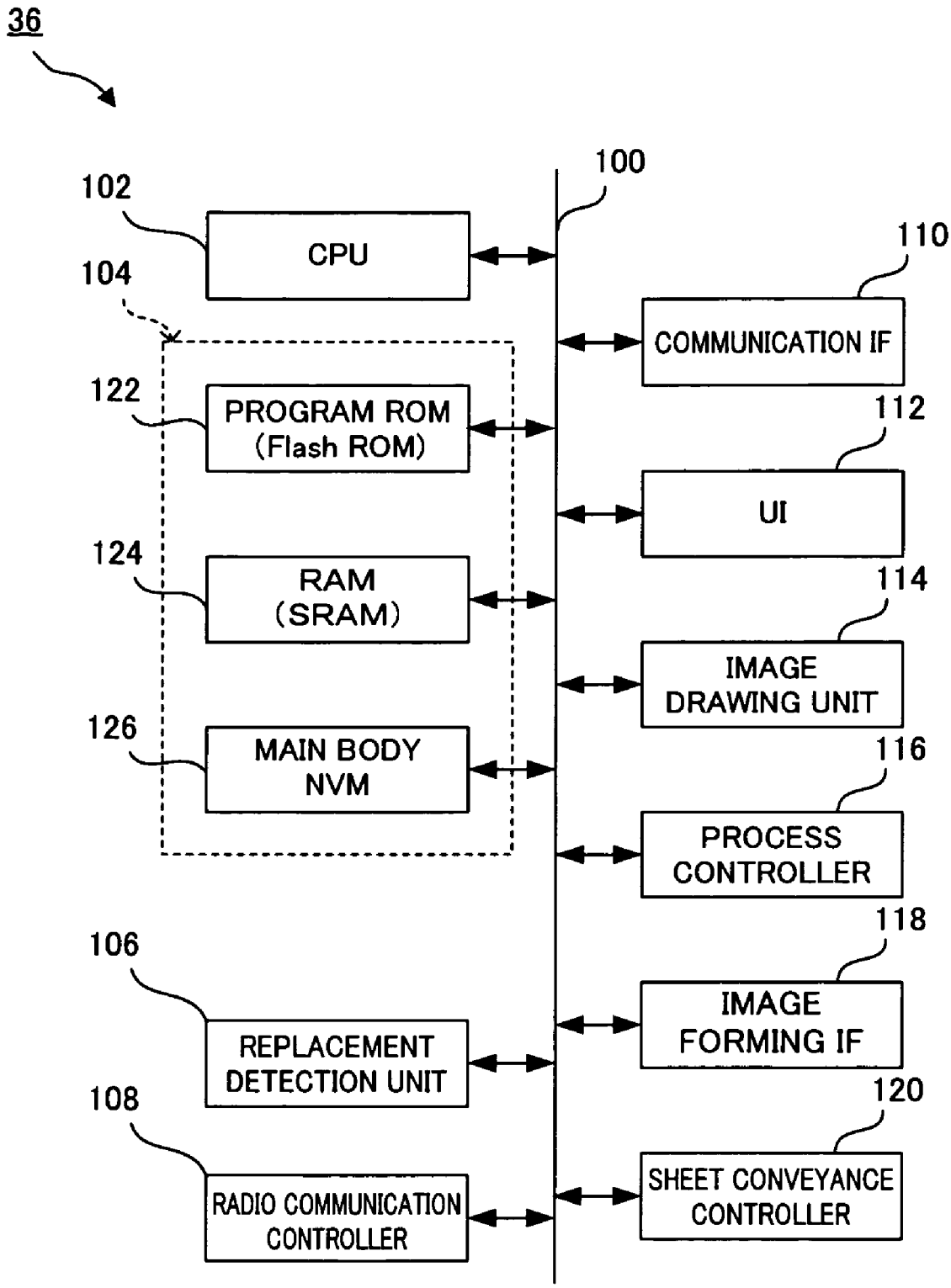
FIG. 2 is a block diagram showing the configuration of a controller 36 in the image forming apparatus 10.

FIG. 2 is a block showing the configuration of the controller 36.

As shown in FIG. 2, the controller 36 has a CPU 102, a storage unit 104, a replacement detection unit 106, the radio communication controller 108, a communication interface (IF) 110, a user interface (UI) 112, an image drawing unit 114, a process controller 116, an image forming IF 118 and a sheet conveyance controller 120. These elements input/output signals to/from each other via a bus 100.

The CPU 102 transmits/receives signals to/from the respective constituent elements of the controller 36 via the bus 100, thereby controls the respective constituent elements of the controller 36. The storage unit 104, having a program ROM 122, a RAM 124 and a main body NVM (Non Volatile Memory) 126, holds information necessary for control of the image forming apparatus 10.

The replacement detection unit 106 detects replacement of a replacement unit such as the developing material container 50, the image holder unit 26 or the transfer unit 28, and outputs a signal informing the replacement to the CPU 102. The radio communication controller 108 having an antenna (not shown) transmits/receives a signal to/from the memory chip 56 provided in the developing material container 50, and transmits/receives signals to/from the CPU 102, the storage unit 104 and the like via the bus 100.

The communication IF 110 transmits/receives data to/from an external computer such as a host computer via a network (not shown), and transmits/receives data to/from the CPU 102 via the bus 100.

The UI 112, having a touch panel or buttons, a liquid crystal display and the like, receives a user's input and outputs it to the CPU 102. Further, the UI 112 displays a display content designated by the CPU 102.

The UI 112 may be a display and an input device such as a keyboard, a mouse and the like of an external computer connected via the network. In this case, a predetermined setting screen is displayed by, e.g., driver software on the display of the computer. Accordingly, an input via such setting screen is received by the computer as the UI 112, then transmitted via the network to the controller 36 of the image forming apparatus 10, and received by the CPU 102.

The image drawing unit 114 draws an image based on an image forming signal inputted from the external computer or the like, and outputs the image to the CPU 102 and the RAM 124. The process controller 116, together with the CPU 102, refers to set values and the like stored in the storage unit 104, and controls the image holder unit 26, the transfer unit 28, the exposure device and the like via the image forming IF 118. Further, the process controller 116 changes the control content based on the result of processing by a life detection program 200 to be described later. The sheet conveyance controller 120, together with the CPU 102, controls the feed roller 20, the retard roller 22, registration roller 24 and the like.

In the storage unit 104, the program ROM 122 has, e.g., a flash ROM. The program ROM 122 holds an execution program and set values to operate the image forming apparatus 10. The set values include, e.g., respective life threshold values, toner density parameter group and image density parameter group. The life threshold values indicate respective lives of the replaceable units in the image forming apparatus 10. The toner density parameter group includes respective parameters related to toner density control in the developing devices 44. The image density parameter group includes respective parameters related to image density control on e.g. the image holders 40.

The RAM 124 having e.g. an SRAM holds information such as drawing data inputted from the image drawing unit 114. The main body NVM 126 has an electrically rewritable nonvolatile memory such as an EEPROM or a flash ROM. Note that the main body NVM 126 is a rewritable storage device which holds its storage content even when a power source is turned off (i.e., a nonvolatile memory). Note that the main body NVM 126 may be an SRAM or a hard disk drive optical memory with its power source backed up with a battery or the like.

The main body NVM 126 holds attachment records of the respective replacement units and respective life count values on the main body side. The attachment record of each replacement unit includes information indicating whether or not the attached replacement unit is a genuine part. The respective life count values on the main body side indicate the amounts of use of the respective replacement units of the image forming apparatus 10 from the start of use to the current time. Note that the main body NVM 126 may hold toner densities in the developing devices 44, an image densities on the image holders 40, voltage values applied to the respective constituent elements, current values detected from the respective constituent elements (e.g. the transfer unit 28) and the like in a predetermined period.

Figure 3:
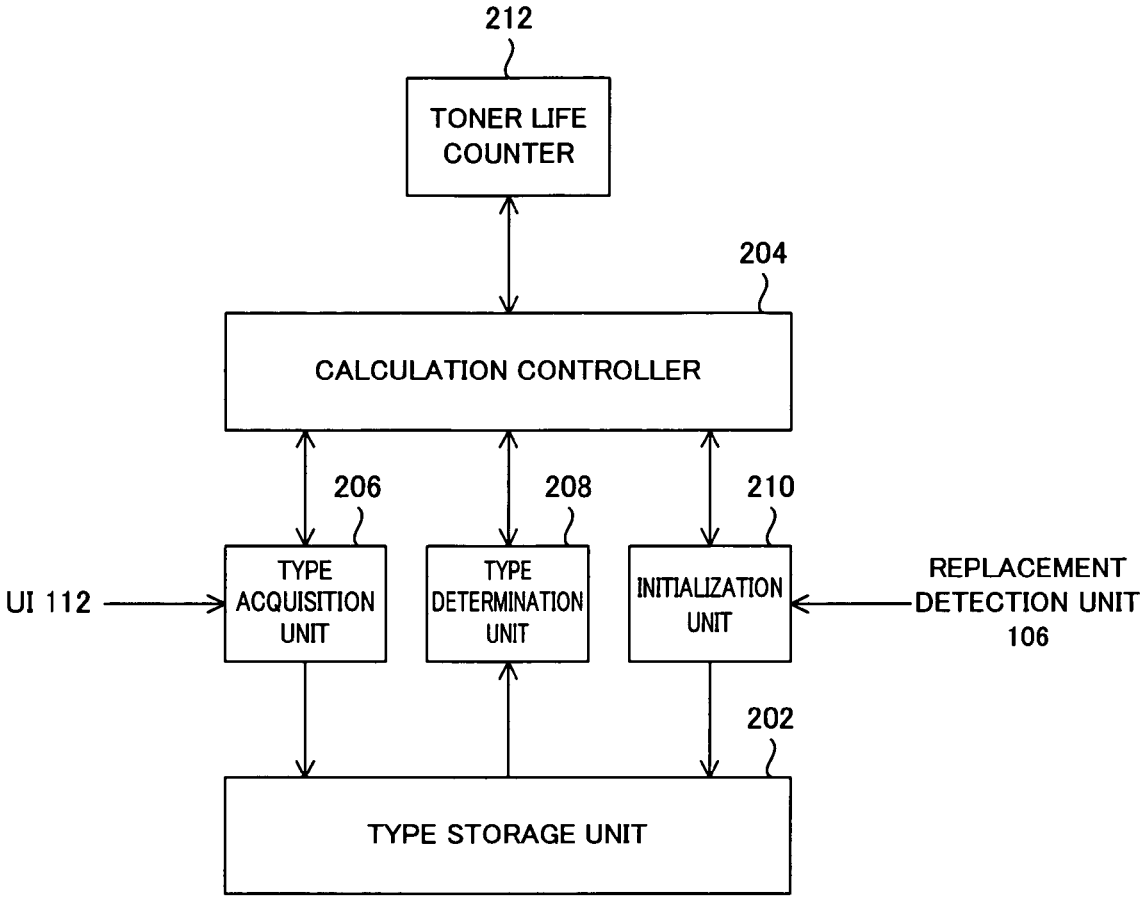
FIG. 3 is a block diagram showing the functional configuration of a life detection program 200 executed by the controller 36 in the image forming apparatus 10 according to a first exemplary embodiment of the present invention.

FIG. 3 is a block diagram showing the functional configuration of the life detection program 200 executed by the controller 36 in the image forming apparatus 10 according to the first exemplary embodiment of the present invention.

As shown in FIG. 3, the life detection program 200 has a type storage unit 202, a calculation controller 204, a type acquisition unit 206, a type determination unit 208, an initialization unit 210 and a toner life counter 212. The life detection program 200 is stored in, e.g., the program ROM 122, and is executed by particularly utilizing hardware on an OS (not shown) operating on the CPU 102 of the controller 36. Note that all or a part of the elements of the life detection program 200 may be realized as hardware.

In the life detection program 200, the type storage unit 202 holds information indicating the types of respective replaceable units such as the developing material container 50. The type of replacement unit is information indicating whether or not the replacement unit is a genuine part. More particularly, the type storage unit 202 holds a flag indicating whether or not a unit other than a genuine part has been attached in the past. For example, the initial value of the flag is "0", and when a unit other than brand-name part has been attached before, the flag value is "1". In this manner, the type storage unit 202 functions as an information storage unit holding information indicating a type. Note that the type storage unit 202 is realized with, e.g., the main body NVM 126.

The type acquisition unit 206 obtains the type of a replacement unit such as the developing material container 50 inputted via the UI 112 from the user, and outputs the type of the replacement unit to the calculation controller 204, and stores it into the type storage unit 202. For example, when the type indicates that the replacement unit is other than a genuine part, the type acquisition unit 206 sets the corresponding flag in the type storage unit 202 to "1". In this manner, the type acquisition unit 206 functions as an information reception unit to receive information indicating the type of a replacement unit such as the developing material container 50.

When the replacement detection unit 106 detects that a replacement unit different from the developing material container 50 (e.g., the image holder unit 26) has been replaced, the initialization unit 210 initializes the information indicating the type stored in the type storage unit 202. For example, the initialization unit 210 sets the stored flag to "0". Note that it may be arranged such that the initialization unit 210 initializes the flag when the image holder unit 26 and the transfer unit 28 have been replaced. The timing of initialization is not particularly limited.

The type determination unit 208 determines the information indicating the type stored in the type storage unit 202 under the control of the calculation controller 204. More particularly, the type determination unit 208 refers to the stored information and determines whether or not the type indicates a particular type. That is, the type determination unit 208 determines whether or not the type indicates that the developing material container 50 is other than a genuine part. For example, the type determination unit 208 determines whether or not the flag is "1". The type determination unit 208 outputs the result of determination to the calculation controller 204.

The toner life counter 212 counts toner life count value and waste toner life count value of the developing material container 50. Note that the toner life count value and the toner life threshold value are individually set for each color. The toner life counter 212 calculates the toner life count value based on the number of revolutions of the conveyance member provided in the first coupling member 66, the operation time of the conveyance member and the like. The toner life counter 212 calculates the waste toner life count value based on the calculated toner life count value.

The toner life counter 212 outputs the toner life count value and the waste toner life count value to the calculation controller 204. Note that the toner life counter 212 may store the toner life count value and the waste toner life count value into the memory chip 56 of the developing material container 50.

The calculation controller 204 controls calculation of the life of a replacement unit such as the developing material container 50 based on the information stored in the type storage unit 202. Note that the calculation controller 204 receives the result of determination by the type determination unit 208, and changes the way of life calculation based on the result of determination.

More particularly, when a currently-attached developing material container 50 is a genuine part and all the past-attached developing material containers 50 have been genuine parts, the calculation controller 204 performs first life detection processing.

Further, when the currently-attached developing material container 50 is other than a genuine part, the calculation controller 204 performs second life detection processing. In the second life detection processing, the calculation controller 204 calculates the life such that it expires earlier than that in the first life detection processing.

Further, when the currently-attached developing material container 50 is a genuine part and at least one of the past-attached developing material containers 50 have been other than a genuine part, the calculation controller 204 performs third life detection processing.

Hereinbelow, the first life detection processing to the third life detection processing will be described in detail based on FIGS. 4 to 6.

Figure 4:
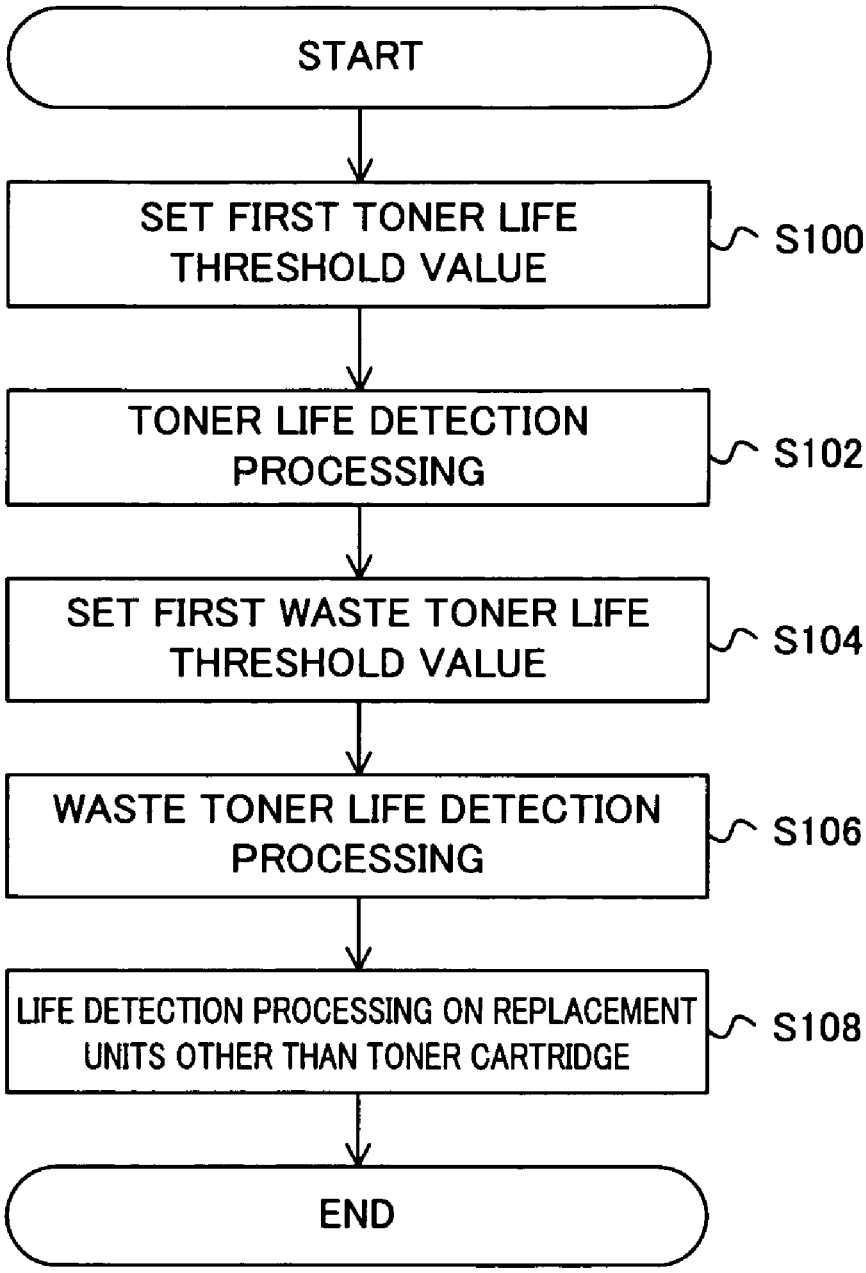
FIG. 4 is a flowchart showing first life detection processing (S10) performed by the controller 36.

FIG. 4 is a flowchart showing the first life detection processing (S10) performed by the controller 36.

As shown in FIG. 4, at step S100, the calculation controller 204 of the life detection program 200 sets a first toner life threshold value. More particularly, the calculation controller 204 reads a toner life threshold value of the developing material container 50 stored in the memory chip 56 of the developing material container 50 or in the main body NVM 126, and uses the read toner life threshold value in the subsequent processing.

At step S102, the calculation controller 204 performs toner life detection processing. More particularly, the calculation controller 204 compares the toner life count value inputted from the toner life counter 212 with the toner life threshold value. When the toner life count value is equal to or greater than the toner life threshold value, the calculation controller 204 determines that the life of the developing material container 50 has been expired. Note that the calculation controller 204 performs the toner life detection processing on the developing material containers 50 of respective colors.

At step S104, the calculation controller 204 sets a first waste toner life threshold value. More particularly, the calculation controller 204 reads a waste toner life threshold value of the developing material container 50 stored in the memory chip 56 of the developing material container 50 or in the main body NVM 126, and uses the read waste toner life threshold value in the subsequent processing.

At step S106, the calculation controller 204 performs waste toner life detection processing. More particularly, the calculation controller 204 compares the waste toner life count value inputted from the toner life counter 212 with the waste toner life threshold value. When the waste toner life count value is equal to or greater than the waste toner life threshold value, the calculation controller 204 determines that the life of the developing material container 50 has been expired. Note that the calculation controller 204 performs the waste toner life detection processing on the respective color developing material containers 50.

At step S108, the calculation controller 204 performs life detection processing on replacement units other than the developing material container 50. More particularly, the calculation controller 204 compares the life count values of the respective replacement units stored in the main body NVM 126 with the life threshold values of the respective replacement units stored in the program ROM 122, and determine whether or not the lives of the respective replacement units have been expired.

Figure 5:
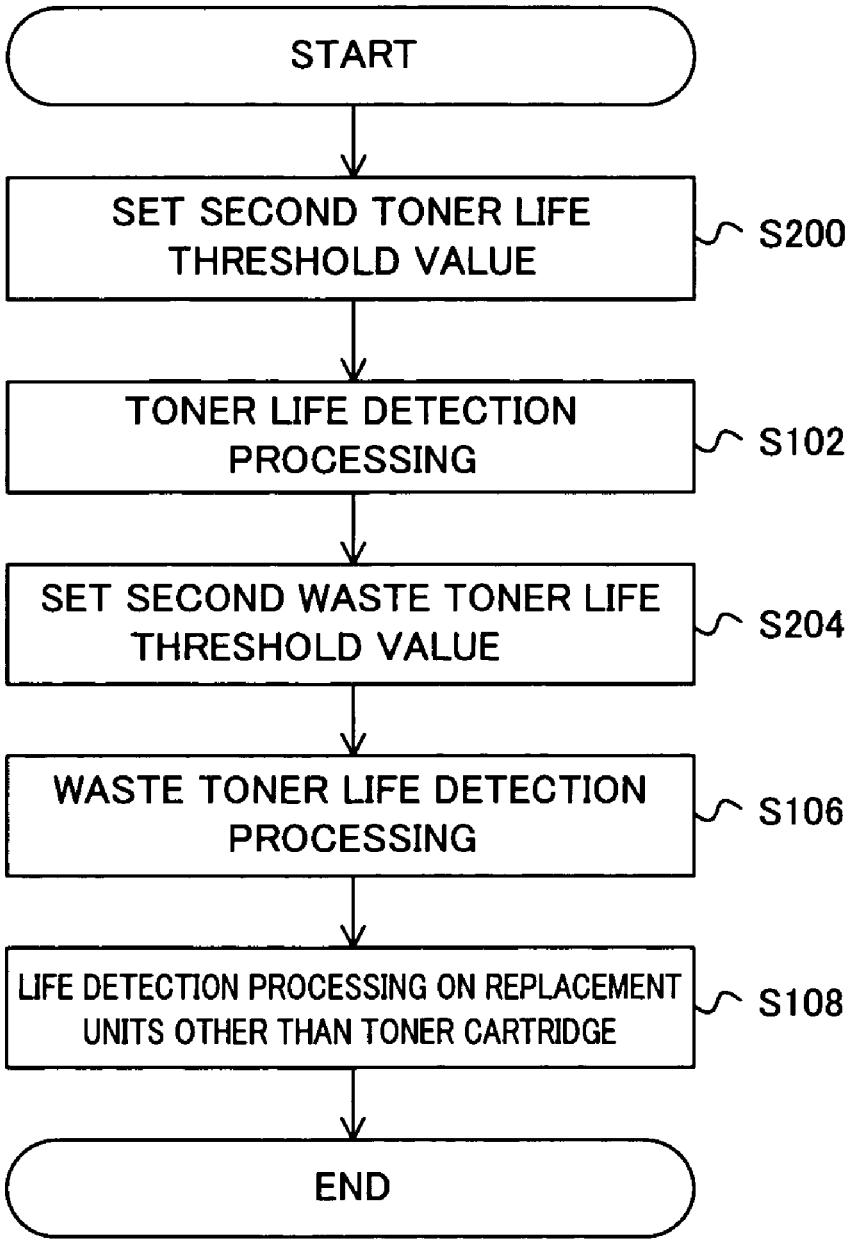
FIG. 5 is a flowchart showing second life detection processing (S20) performed by the controller 36.

FIG. 5 is a flowchart showing the second life detection processing (S20) performed by the controller 36. Note that among respective processing steps shown in FIG. 5, processing steps corresponding to those shown in FIG. 4 have the same reference numerals.

As shown in FIG. 5, at step S200, the calculation controller 204 of the life detection program 200 sets a second toner life threshold value. More particularly, the calculation controller 204 reads the toner life threshold value of the developing material container 50 stored in the memory chip 56 of the developing material container 50 or in the main body NVM 126, and uses a value less than the read toner life threshold value (e.g., a value obtained by multiplying the read toner life threshold value by a coefficient less than "1") as a toner life threshold value. After the setting of the toner life threshold value, the toner life detection processing is performed at step S102.

At step S204, the calculation controller 204 sets a second waste toner life threshold value. More particularly, the calculation controller 204 reads the waste toner life threshold value of the developing material container 50 stored in the memory chip 56 of the developing material container 50 or in the main body NVM 126, and uses a value less than the read waste toner life threshold value as a toner life threshold value. After the setting of the waste toner life threshold value, the waste toner life detection processing is performed at step S106.

Further, at step S108, the life detection processing is performed on the replacement units other than the developing material container 50. Note that in the life detection processing, the calculation controller 204 may read the life threshold value stored in the program ROM 122 and use a value less than the read life threshold value as a life threshold value.

Figure 6:
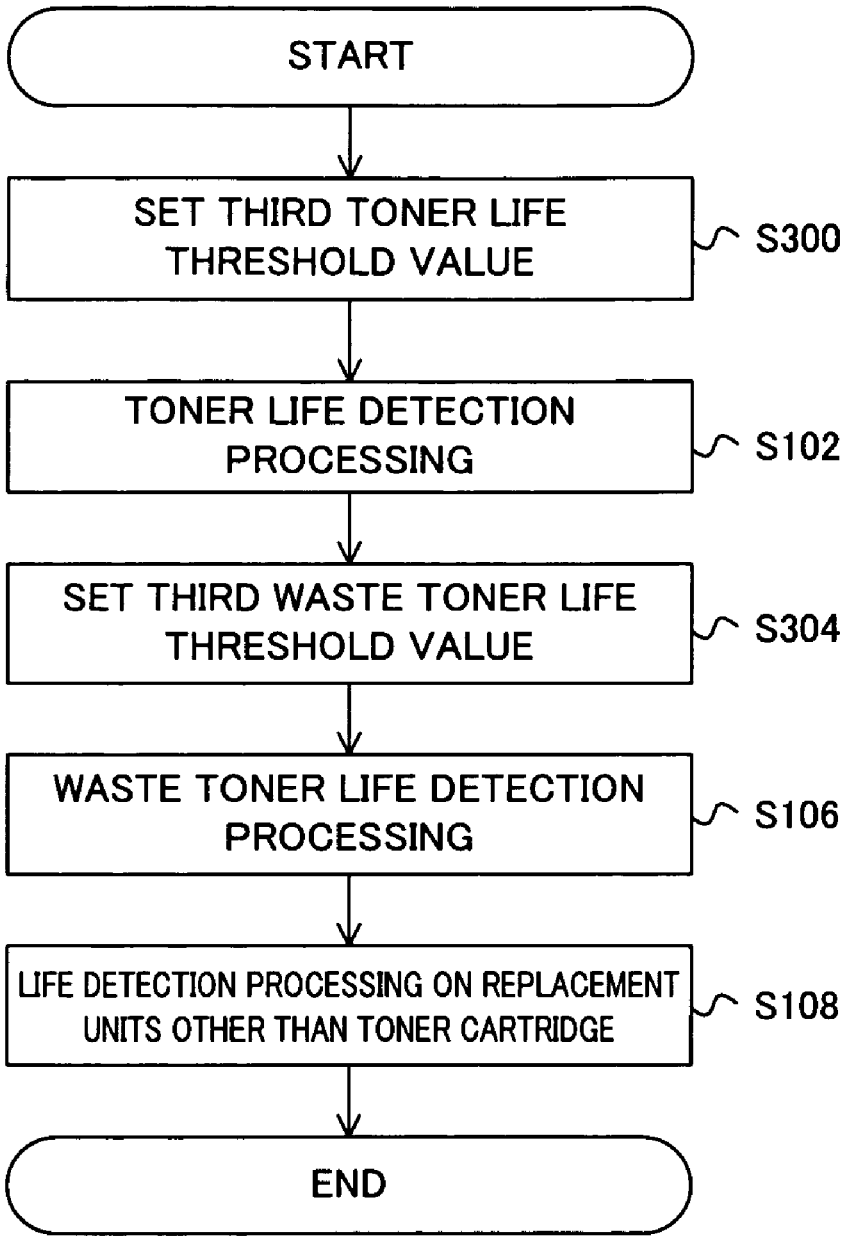
FIG. 6 is a flowchart showing third life detection processing (S30) performed by the controller 36.

FIG. 6 is a flowchart showing the third life detection processing (S30) performed by the controller 36. Note that among respective processing steps shown in FIG. 6, processing steps corresponding to those shown in FIG. 4 have the same reference numerals.

As shown in FIG. 6, at step S300, the calculation controller 204 of the life detection program 200 sets a third toner life threshold value. Note that the third toner life threshold value is equal to or less than the first toner life threshold value and equal to or greater than the second toner life threshold value. The third toner life threshold value may be equal to the first toner life threshold value. After the setting of the third toner life threshold value, the toner life detection processing is performed at step S102.

At step S304, the calculation controller 204 sets a third waste toner life threshold value. Note that the third waste toner life threshold value is equal to or less than the first waste toner life threshold value and equal to or greater than the second waste toner life threshold value. After the setting of the third waste toner life threshold value, the waste toner life detection processing is performed at step S106.

Further, at step S108, the life detection processing is performed on the replacement units other than the developing material container 50. Note that in the life detection processing, the calculation controller 204 may use a value equal to or less than the threshold value used in the first life detection processing and equal to or greater than the threshold value used in the second life detection processing, as a life threshold value.

Figure 7:
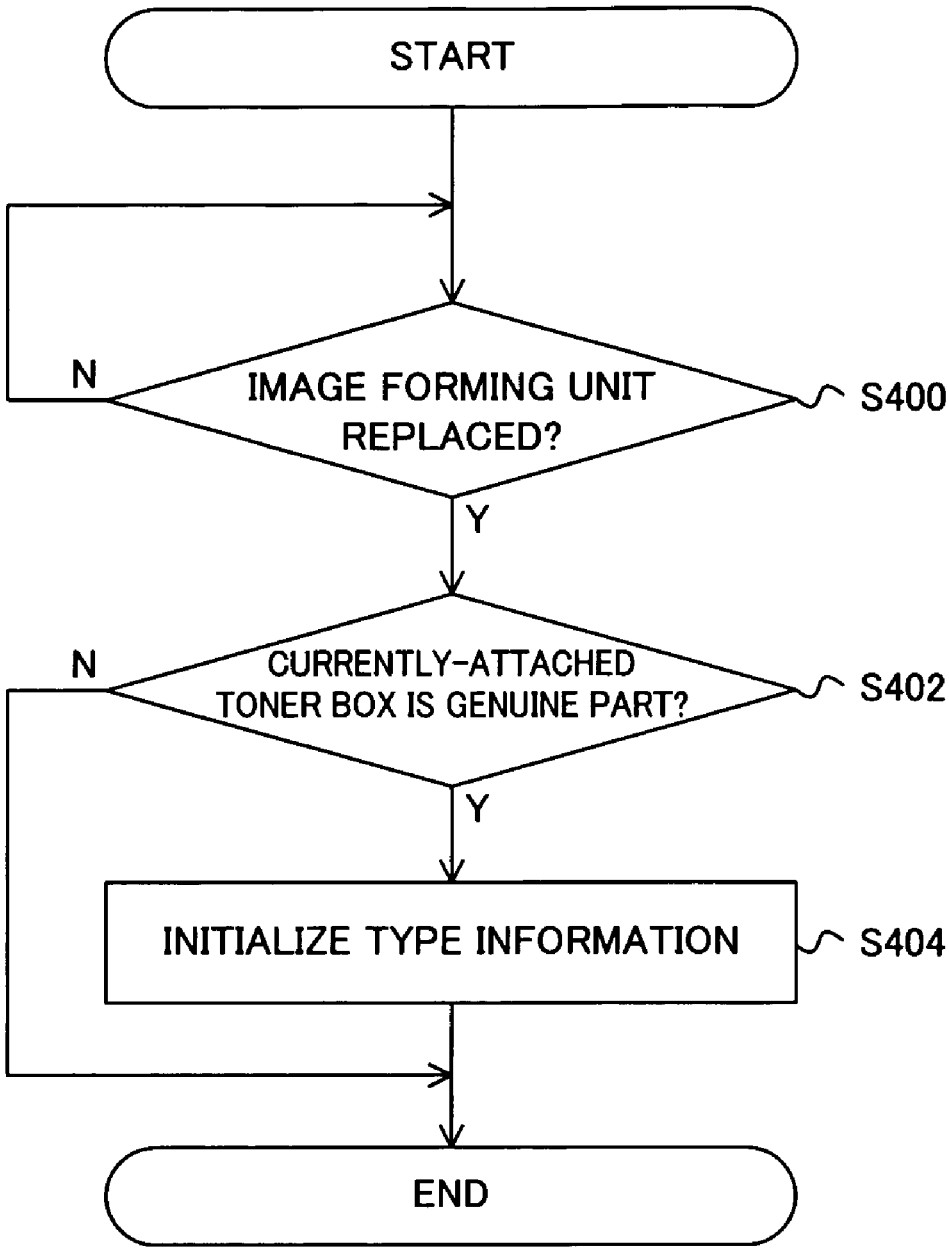
FIG. 7 is a flowchart showing the type initialization processing (S40) performed by the life detection program 200.

FIG. 7 is a flowchart showing the type initialization processing (S40) performed by the life detection program 200.

As shown in FIG. 7, at step S400, the initialization unit 210 of the life detection program 200 determines whether or not the replacement detection unit 106 has detected replacement of a replacement unit different from the developing material container 50 such as the image holder unit 26. When replacement of a replacement unit different from the developing material container 50 has been detected, the life detection program 200 proceeds to step S402, otherwise, it returns to step S400.

At step S402, the initialization unit 210 determines whether or not the currently-attached developing material container 50 is a genuine part. More particularly, the initialization unit 210 refers to the latest information on the developing material container 50 stored in the type storage unit 202 and uses the information in determination. When the developing material container 50 is a genuine part, the initialization unit 210 proceeds to step S404, otherwise, the process is terminated.

At step S404, the initialization unit 210 initializes the information on the developing material container 50 stored in the type storage unit 202. Note that at steps S402 to S404, the determination processing and the initialization processing are performed for each color.

Figure 8:
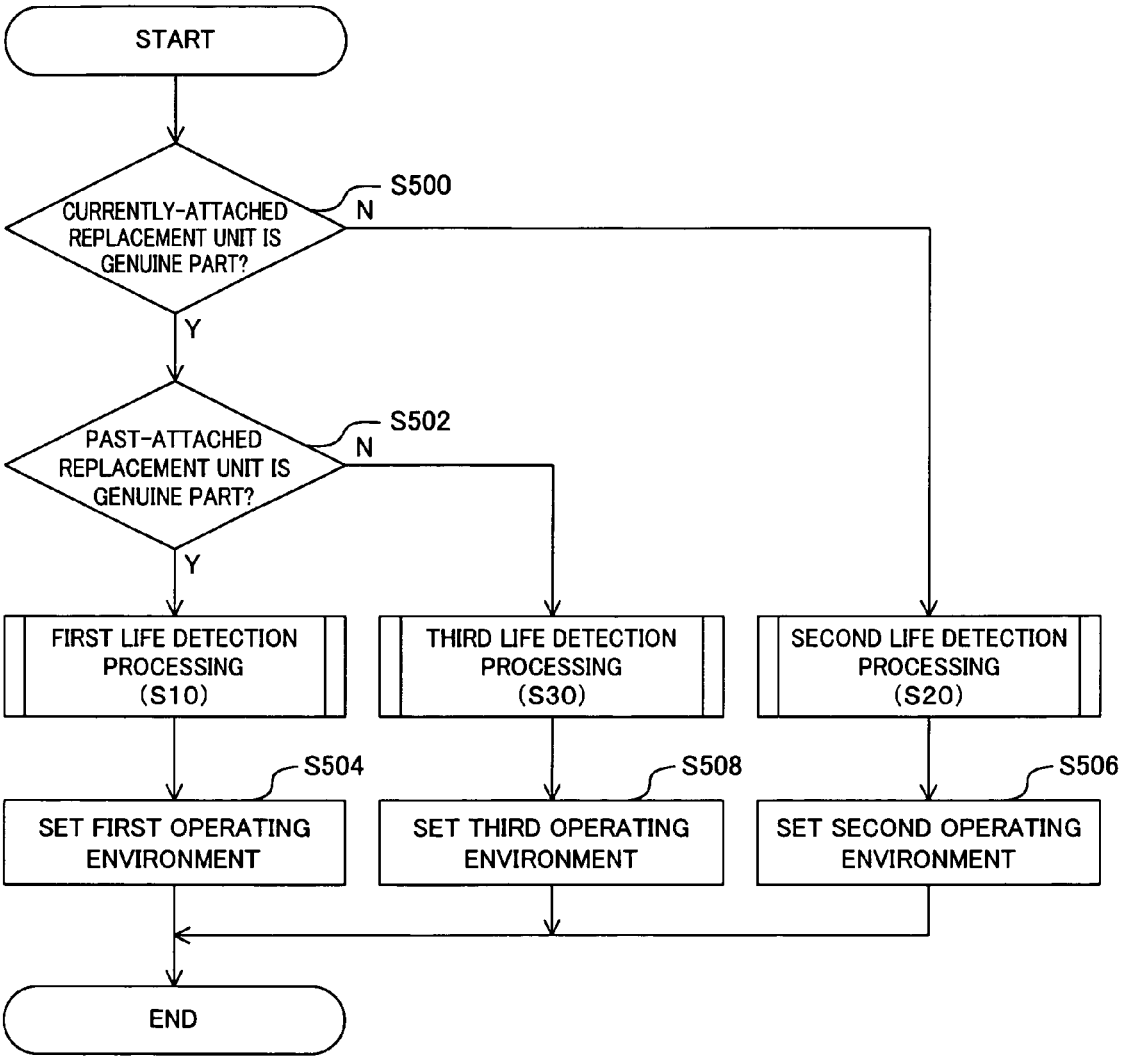
FIG. 8 is a flowchart showing operating environment control processing (S50) performed by the image forming apparatus 10 according to the first exemplary embodiment of the present invention.

FIG. 8 is a flowchart showing the operating environment control processing (S50) performed by the image forming apparatus 10 according to the present exemplary embodiment.

As shown in FIG. 8, at step S500, the type acquisition unit 206 of the life detection program 200 operating on the controller 36 receives a setting regarding a type inputted via the UI 112, and determines whether or not the currently-attached developing material container 50 is a genuine part. When the type acquisition unit 206 determines that the developing material container 50 is a genuine part, the life detection program 200 proceeds to step S502. When the type acquisition unit 206 determines that the developing material container 50 is not a genuine part, the second life detection processing (S20; FIG. 5) is performed.

At step S502, the type determination unit 208 of the life detection program 200 determines whether or not the respective types stored in the type storage unit 202 indicate that the developing material container 50 is a genuine part. When all the types indicate that the developing material container 50 is a genuine part, the first life determination processing (S10; FIG. 4) is performed. When at least one of the types indicates that the developing material container 50 is different from a genuine part, the third life detection processing (S30; FIG. 6) is performed.

When the first life detection processing is performed, at step S504, a first operating environment is set by the process controller 116 of the controller 36. More particularly, the process controller 116 reads the set values such as sheet conveyance speed and fixing temperature stored in the storage unit 104, and sets an operating environment based on the read set values.

When the second life detection processing is performed, at step S506, a second operating environment is set as in the case of the first operating environment. In this case, the process controller 116 sets a speed for sheet conveyance lower than that read from the storage unit 104. Further, the process controller 116 sets a fixing temperature higher than that read from the storage unit 104. Note that the changed set values may be previously stored in the storage unit 104.

When the third life detection processing is performed, at step S508, a third operating environment is set as in the case of the first operating environment. In this case, the process controller 116 sets a speed for sheet conveyance equal to or lower than that read from the storage unit 104 and equal to or higher than that used in the processing at step S506. Further, the process controller 116 sets a fixing temperature equal to or high than that read from the storage unit 104 and equal to or lower than that used in the processing at step S506.

Next, the image forming apparatus 10 according to a second exemplary embodiment of the present invention will be described.

The image forming apparatus 10 according to the present exemplary embodiment is different from the image forming apparatus 10 according to the first exemplary embodiment in that the type of a replacement unit such as the developing material container 50 stored in the memory chip 56 provided in the replacement unit is obtained via the radio communication controller 108.

More particularly, the radio communication controller 108 of the controller 36 receives the serial number, the life threshold values, the life count values and the like stored in the memory chip 56, and outputs these pieces of information to the CPU 102. A life detection program 300 to be described later determines whether or not the developing material container 50 is a genuine part based on these pieces of information.

Figure 9:
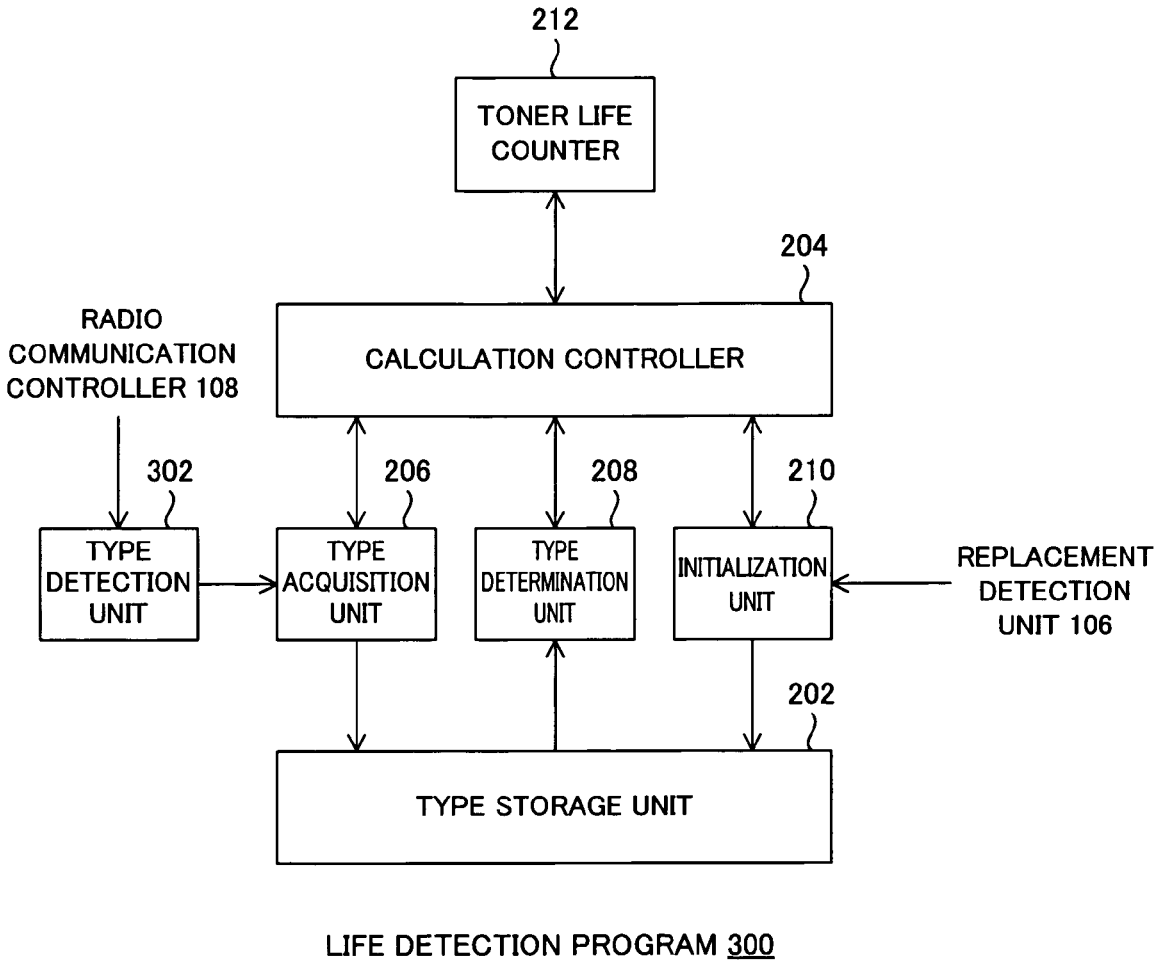
FIG. 9 is a block diagram showing the functional configuration of a life detection program 300 executed by the controller 36 in the image forming apparatus 10 according to a second exemplary embodiment of the present invention.

FIG. 9 is a block diagram showing the functional configuration of the life detection program 300 executed by the controller 36 in the image forming apparatus 10 according to the second exemplary embodiment. Note that among respective constituent elements shown in FIG. 9, elements corresponding to those shown in FIG. 3 have the same reference numerals.

As shown in FIG. 9, the life detection program 300 has a configuration in which a type detection unit 302 is added to the life detection program 200.

In the life detection program 300, the type detection unit 302 receives information inputted from the radio communication controller 108, and detects information indicating the type of a replacement unit such as the developing material container 50 based on the information. More particularly, the type detection unit 302 detects whether or not the replacement unit is a genuine part. In this manner, the type detection unit 302 functions as an information detection unit to detect information indicating the type of a constituent element. Accordingly, the type acquisition unit 206 receives the information detected by the type detection unit 302, outputs the type of the replacement unit to the calculation controller 204, and stores the type into the type storage unit 202.

Note that it may be arranged such that the type detection unit 302 detects the type based on at least one of the result of feedback in control of process such as transfer or exposure, the toner densities in the developing devices 44, the image densities on the image holders 40, the voltage values and the current values, stored in, e.g., the main body NVM 126.

Next, the image forming apparatus 10 according to a third exemplary embodiment of the present invention will be described.

The image forming apparatus 10 according to the present exemplary embodiment is different from the image forming apparatus 10 according to the first embodiment in that the toner life detection processing and the waste toner life detection processing are suppressed in the second life detection processing, and the waste toner life detection processing is suppressed in the third life detection processing.

More particularly, the calculation controller 204 of the life detection program 200 suppresses the calculation of the lives of the supplied developing material container 52 and the recovered developing material container 54 in the second life detection processing. In this example, the calculation controller 204 suppresses the toner life detection processing and the waste toner life detection processing.

For example, the calculation controller 204 performs the second life detection processing with the toner life count value and the waste toner life count value set to a predetermined value (e.g. "0"). In this case, the toner life count value and the waste toner life count value respectively do not exceed the toner life threshold value and the waste toner life threshold value. Accordingly, the life detection program 200 does not perform life detection in the second life detection processing. Note that when the waste toner life count value is "0", the calculation controller 204 performs detection processing on the presumption that the recovered developing material container 54 is always empty.

Further, the calculation controller 204 suppresses the calculation of the life of the recovered developing material container 54 in the third life detection processing. In this example, the calculation controller 204 suppresses the waste toner life detection processing. For example, the calculation controller 204 performs the third life detection processing with the waste toner life count value set to a predetermined value (e.g. "0").

Next, the image forming apparatus 10 according to a fourth exemplary embodiment of the present invention will be described.

The image forming apparatus 10 according to the present exemplary embodiment is different from the image forming apparatus 10 according to the third exemplary embodiment in that the waste toner life count value is "unfixed" thereby the calculation of the life of the recovered developing material container 54 is suppressed in the third life detection processing.

More particularly, the calculation controller 204 of the life detection program 200 performs the processing at step S106 in the third life detection processing (S30; FIG. 6) with an unfixed waste toner life count value. In this case, as the waste toner life count value is unfixed, the comparison between the waste toner life value and the waste toner life threshold value is not performed. Accordingly, the life of the developing material container 50 is not determined based on the waste toner life detection processing. Note that the image forming apparatus 10 may display a message indicating that the waste toner life count value is unfixed on the UI 112.

Next, the image forming apparatus 10 according a fifth exemplary embodiment of the present invention will be described.

The image forming apparatus 10 according to the preset exemplary embodiment is different from the image forming apparatus 10 according to the first embodiment in that life threshold values equal to the toner life threshold value and the waste toner life threshold value used in the first life detection processing are used and life count values different from the toner life count value and the waste toner life count value used in the first life detection processing are used in the second life detection processing and the third life detection processing.

More particularly, the calculation controller 204 of the life detection program 200 compares a value greater than the toner life count value inputted from the toner life counter 212 (e.g., a value obtained by multiplying the input value by a coefficient greater than "1") with the toner life threshold value, and determines the life of the developing material container 50 based on the result of comparison. Similarly, the calculation controller 204 compares a value obtained by multiplying the waste toner life count value inputted from the toner life counter 212 by a coefficient greater than "1" with the waste toner life threshold value, and determines the life of the developing material container 50.

Next, the image forming apparatus 10 according to a sixth exemplary embodiment of the present invention will be described.

The image forming apparatus 10 according to the present exemplary embodiment is different from the image forming apparatus 10 according to the first exemplary embodiment in that it is determined whether or not a constituent element provided in the image forming apparatus 10 is damaged, and the life detection method for the developing material container 50 is changed based on the result of the determination.

Figure 10:
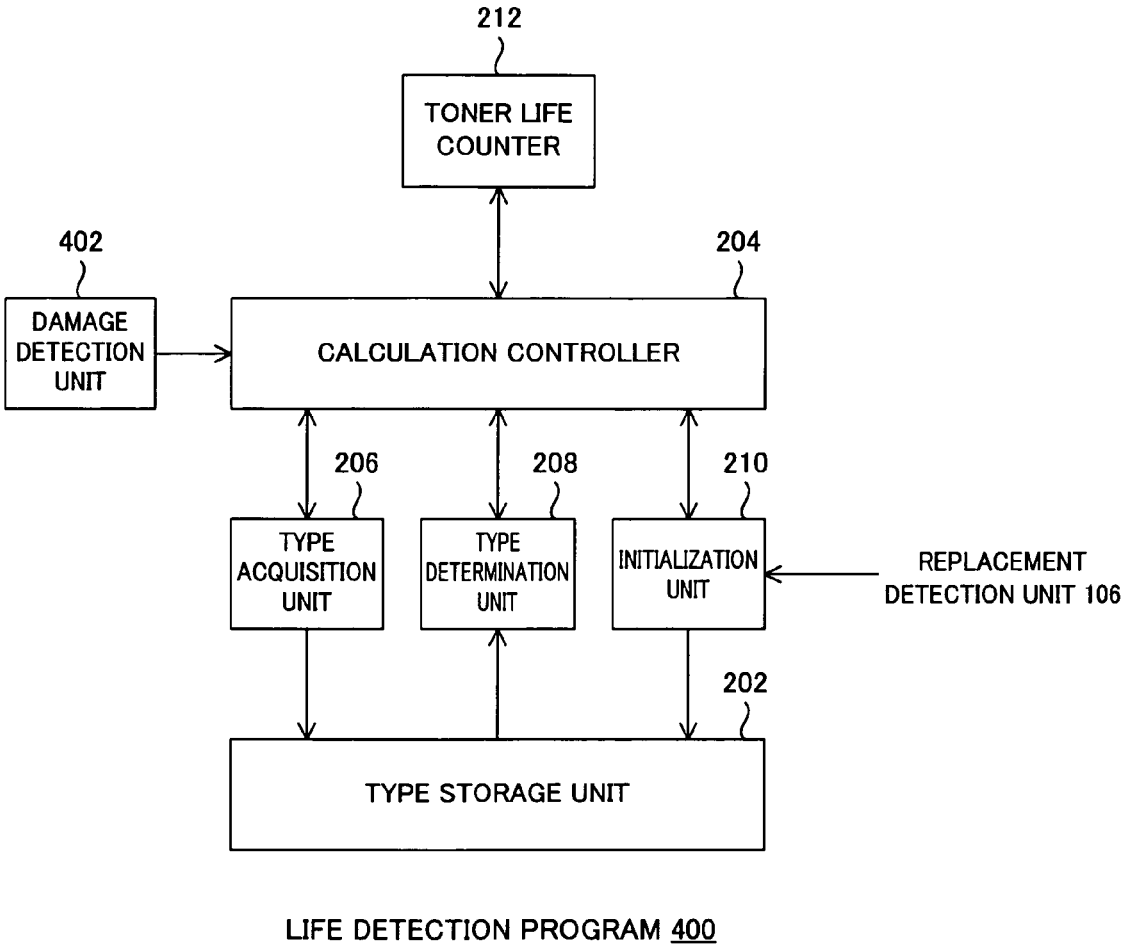
FIG. 10 is a block diagram showing the functional configuration of a life detection program 400 executed by the controller 36 in the image forming apparatus 10 according to a sixth exemplary embodiment of the present invention.

FIG. 10 is a block diagram showing the functional configuration of a life detection program 400 executed by the controller 36 in the image forming apparatus 10 according to the sixth exemplary embodiment. Note that among the respective constituent elements shown in FIG. 10, elements corresponding to those shown in FIG. 3 have the same reference numerals.

As shown in FIG. 10, the life detection program 400 has a configuration in which a damage detection unit 402 is added to the life detection program 200.

In the life detection program 400, the damage detection unit 402 detects damage to a replacement unit other than a predetermined replacement unit (e.g., the developing material container 50) and outputs the detected damage to the calculation controller 204. The damage detection unit 402 detects damage based on the result of image forming processing (e.g., at least one of feed back results such as the toner densities in the developing device 44, the image densities in the image holders 40, the result of transfer and the result of exposure). Note that the damage detection unit 402 may use information stored as feed results in the main body NVM 126.

The calculation controller 204 performs life calculation further based on the damage detected by the damage detection unit 402. More particularly, when at least one piece of the information stored in the type storage unit 202 indicates a particular type and the damage detected by the damage detection unit 402 is less than a predetermined value (i.e., the replacement unit other than the developing material container 50 is not damaged), the calculation controller 204 performs the first life detection processing.

Further, when at least one piece of the information stored in the type storage unit 202 indicates the particular type and the damage detected by the damage detection unit 402 is equal to or greater than the predetermined value (i.e., the replacement unit other than the developing material container 50 is damaged), the calculation controller 204 performs the third life detection processing.

Figure 11:
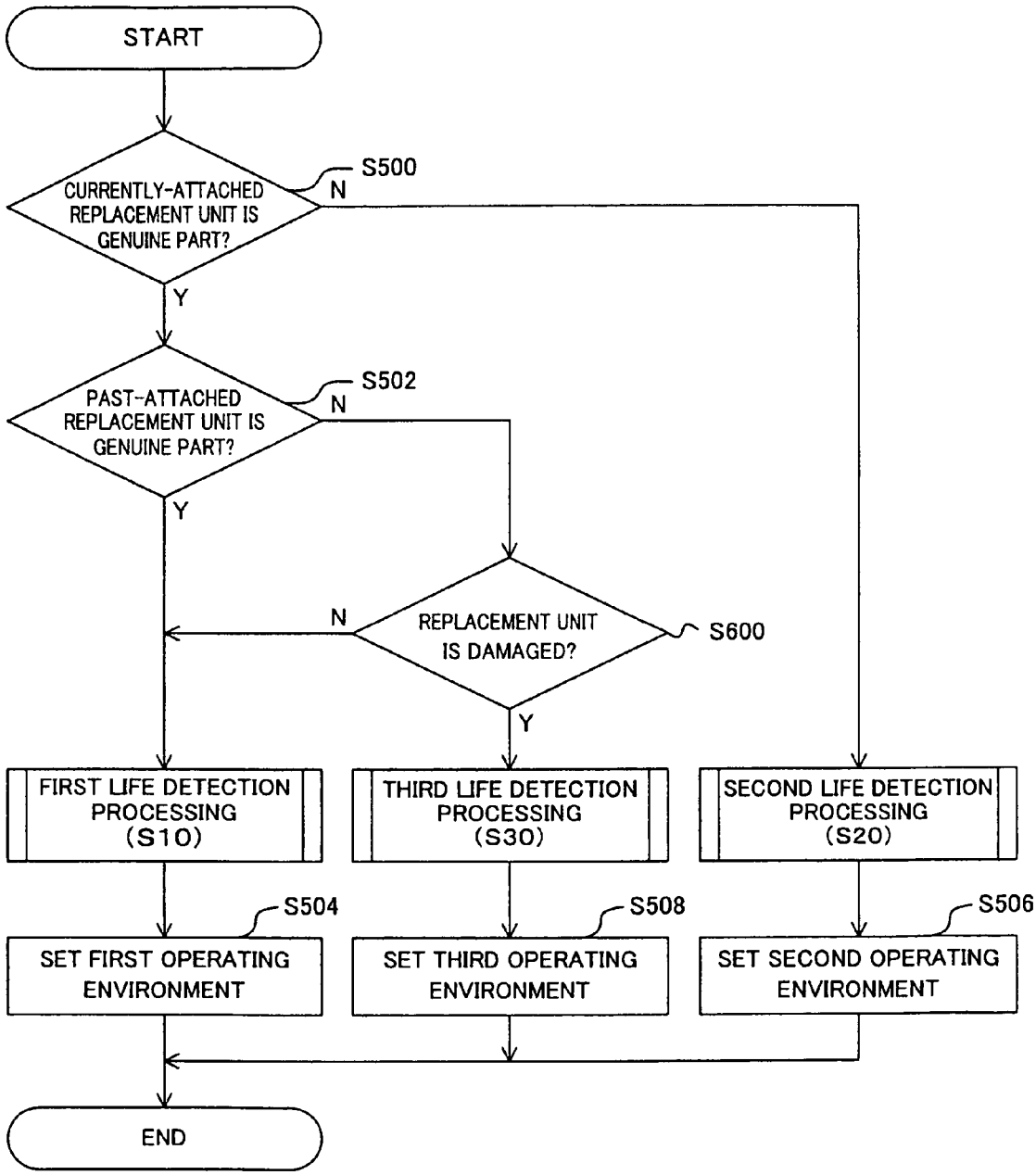
FIG. 11 is a flowchart showing the operating environment control processing (S60) performed by the image forming apparatus 10 according to the sixth exemplary embodiment of the present invention.

FIG. 11 is a flowchart showing the operating environment control processing (S60) performed by the image forming apparatus 10 according to the sixth exemplary embodiment. Note that among respective processing steps shown in FIG. 11, processing steps corresponding to those shown in FIG. 8 have the same reference numerals.

As shown in FIG. 11, at step S600, the damage detection unit 402 determines whether or not a replacement element different from the developing material container 50 has been damaged. When the damage detection unit 402 determines that the replacement element has not been damaged, the first life detection processing (S10) is performed. On the other hand, when the damage detection unit 402 determines that the replacement element has been damaged, the third life detection processing (S30) is performed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a replaceable replacement unit;

an information storage unit that holds information indicating a type of the replacement unit received by a user interface; and a life calculation controller that, when at least one piece of the information stored in the information storage unit indicates a particular type, performs control to suppress calculation of a life of the replacement unit.

2. The image forming apparatus according to claim 1, wherein upon replacement of the replacement unit, when the information indicating the particular type is stored in the information storage unit, the life calculation controller performs control to suppress the calculation of a life of the replaced replacement unit.

3. The image forming apparatus according to claim 1, wherein the life calculation controller performs control to suppress the calculation of the life of the replacement unit and the life of a replacement unit to be attached thereafter.

4. The image forming apparatus according to claim 1, wherein the information storage unit holds information indicating whether or not the replacement unit is a genuine part.

5. The image forming apparatus according to claim 4, wherein the life calculation controller calculates the life of the replacement unit such that the life of the replacement unit expires earlier than the life of the genuine part to perform control to suppress the calculation of the life replacement unit when the information storage unit holds information indicating that the replacement unit is not the genuine part.

6. An image forming apparatus comprising:

a replaceable replacement unit;

an information reception unit that receives information indicating a type of the replacement unit;

an information storage unit that holds the information received by the information reception unit; and a life calculation controller that, when at least one piece of the information stored in the information storage unit indicates a particular type, performs control to suppress calculation of a life of the replacement unit.

7. The image forming apparatus according to claim 6, wherein the replacement unit comprises a developing material container that contains supplied developing material or recovered developing material.

8. The image forming apparatus according to claim 7, wherein upon replacement of the replacement unit, when the information indicating the particular type is stored in the information storage unit, the life calculation controller performs control to suppress the calculation of a life of the replaced replacement unit.

9. The image forming apparatus according to claim 7, wherein the life calculation controller performs control to suppress the calculation of the life of the developing material container and the life of the developing material container to be attached thereafter.

10. The image forming apparatus according to claim 7, further comprising a damage detection unit that detects damage to the replacement unit other than the developing material container, wherein the life calculation controller controls to suppress the calculation of the life of the replacement unit further based on the damage detected by the damage detection unit.

11. The image forming apparatus according to claim 10, wherein the damage detection unit detects damage based on a result of image forming processing.

12. The image forming apparatus according to claim 10, wherein when at least one piece of the information stored in the information storage unit indicates a particular type and the damage detected by the damage detection unit is less than a predetermined value, the life calculation controller performs the calculation of the life of the developing material container.

13. The image forming apparatus according to claim 10, wherein when at least one piece of the information stored in the information storage unit indicates a particular type and the damage detected by the damage detection unit is equal to or greater than a predetermined value, the life calculation controller suppresses the calculation of the life of the developing material container.

14. The image forming apparatus according to claim 6, further comprising:

a replacement detection unit that detects replacement of the replacement unit different from the developing material container; and an information initialization unit that, when the replacement detection unit detects replacement of the replacement unit, initializes the information stored in the information storage unit.

15. The image forming apparatus according to claim 6, wherein the information storage unit holds information indicating whether or not the replacement unit is a genuine part.

16. The image forming apparatus according to claim 15, wherein the life calculation controller calculates the life of the replacement unit such that the life of the replacement unit expires earlier than the life of the genuine part to perform control to suppress the calculation of the life replacement unit when the information storage unit holds information indicating that the replacement unit is not the genuine part.

* * * * *